US005195494A

United States Patent [19]

Tuckey

[11] Patent Number: 5,195,494

[45] Date of Patent: Mar. 23, 1993

[54] FUEL DELIVERY SYSTEM WITH OUTLET PRESSURE REGULATION

[75] Inventor: Charles H. Tuckey, Cass City, Mich.

[73] Assignee: Walbro Corporation, Cass City, Mich.

[21] Appl. No.: 842,561

[22] Filed: Feb. 27, 1992

[51] Int. Cl.[5] ..... F02M 37/04

[52] U.S. Cl. ..... 123/514; 123/510; 137/549; 210/172

[58] Field of Search ..... 123/497, 514, 516, 510, 123/509, 457; 137/549, 110; 210/416.4, 420, 172, 110

[56] References Cited

U.S. PATENT DOCUMENTS

| | | | |
|---|---|---|---|
| 3,741,240 | 6/1973 | Berriman | 123/512 |
| 4,051,031 | 9/1977 | Suzuki | 210/420 |
| 4,187,813 | 2/1980 | Stumpp | 123/510 |
| 4,300,502 | 11/1981 | Driggers | 123/512 |
| 4,320,734 | 3/1982 | Balachadran | 123/510 |
| 4,570,604 | 2/1986 | Thornton | 123/514 |
| 4,574,962 | 3/1986 | Müller | 123/510 |
| 4,617,116 | 10/1986 | Seiller | 210/172 |
| 4,649,884 | 3/1987 | Tuckey . | |
| 4,747,388 | 9/1991 | Tuckey et al. . | |
| 4,770,150 | 9/1988 | Fraenkle | 123/510 |
| 4,883,083 | 11/1989 | Fisher | 137/110 |
| 4,933,093 | 6/1990 | Keller | 123/512 |
| 5,049,269 | 9/1991 | Shah | 137/549 |
| 5,078,167 | 1/1992 | Bradt | 137/549 |
| 5,080,077 | 1/1992 | Sawert | 123/509 |

*Primary Examiner*—Carl S. Miller

*Attorney, Agent, or Firm*—Barnes, Kisselle, Raisch, Choate, Whittemore & Hulbert

[57] ABSTRACT

A fuel delivery system that includes a fuel pump having an inlet for drawing fuel from a fuel supply and an outlet connected to a fuel filter so that fuel delivered to the engine by the pump flows through the filter. A check valve is positioned between the filter outlet and the fuel line to the engine so as to prevent reverse flow of fuel from the engine to the supply when the pump is shut down. A pressure reference inlet connected to the outlet side of the fuel filter on the downsream side of the check valve. The outlet of the pressure regulator is connected to return fuel to the fuel supply bypassing the filter as a function of fuel pressure at the filter so as to maintain substantially constant fuel pressure delivery to the engine. The reference input to the pressure regulator is connected to the engine fuel line. Any fuel pressure increase at the engine and in the fuel line due to heat or the like automatically opens the regulator so as to vent the pump outlet to the supply.

8 Claims, 3 Drawing Sheets

FUEL DELIVERY SYSTEM WITH OUTLET PRESSURE REGULATION

The present invention is directed to fuel delivery systems for internal combustion engines and like applications, and more particularly to a system for maintaining constant fuel delivery pressure.

BACKGROUND AND OBJECTS OF THE INVENTION

U.S. Pat. No. 4,649,884 discloses a fuel delivery system for an internal combustion engine in which an electric-motor constant-delivery fuel pump supplies fuel under pressure from a tank to a fuel rail positioned on an engine. A fuel pressure regulator is connected to the fuel rail to return excess fuel to the supply tank as a function of pressure differential between the fuel rail and the engine air intake manifold, which thus supplies the reference input to the pressure regulator. A plurality of fuel injectors are mounted between the fuel rail and the engine air intake manifold, with the injector nozzles being positioned adjacent to the fuel/air intake ports of the individual engine cylinders.

To overcome a problem of heat transfer from the engine to the fuel tank by the fuel returned from the supply, it has heretofore been proposed to supply fuel to the engine by means of a pressure-controlled electric-motor fuel pump and a one-way or non-return fuel line that connects the pump to the fuel rail at the engine. For example, U.S. Pat. No. 5,044,344 discloses a fuel delivery system in which a fuel pump is responsive to application of electrical power for supplying fuel under pressure from the tank to the fuel rail. A check valve is positioned in the fuel line between the pump outlet and the fuel rail for preventing reverse flow of fuel from the engine to the pump when the pump is shut down. A pressure sensor is operatively coupled to the fuel line between the pump outlet and the check valve, and is connected to electronic circuitry for applying electrical energy to the pump motor as a function of pressure in the fuel line. A pressure relief valve is connected to the fuel line between the check valve and the engine for returning fuel from the engine to the supply in the event of over-pressure in the fuel line.

Although the fuel delivery systems so disclosed address and overcome a number of problems theretofore extant in the art, further improvements remain desirable. For example, placement of a fuel filter in the fuel line between the pump and the engine in a non-return fuel delivery system causes loss of fuel pressure control at the engine as &he filter becomes clogged. Another and continuing problem in the art involves fuel vaporization in the fuel line and at the fuel supply at very high temperatures. For example, fuel rail temperature tends to increase significantly after the engine is turned off and coolant system operation terminates. The fuel may vaporize in the rail and injector area, and at the pump, particularly when ambient temperature is relatively high. Such fuel vaporization typically causes difficulty in restarting the engine and/or unstable idling performance.

It is therefore a general object of the present invention to provide a fuel delivery system for internal combustion engines that includes facility for direct control of fuel pressure at the outlet of the fuel filter so as to maintain substantially constant fuel delivery pressure to the engine as the filter becomes clogged. Another object of the present invention is to provide a fuel delivery system for internal combustion engines in which increasing fuel pressure in the fuel line to the engine under high heat conditions automatically vents the fuel pump so as to reduce vapor formation at the pump. Another object of the present invention is to provide a fuel delivery system that obtains one or both of the aforementioned objectives without use of costly electronic control components and circuitry. A further object of the present invention is to provide a fuel delivery system of the described character in the form of an integral fuel module assembly constructed for immersion in a vehicle fuel tank.

SUMMARY OF THE INVENTION

A fuel delivery system in accordance with the present invention includes a fuel pump having an inlet for drawing fuel from a fuel supply and an outlet connected to a fuel filter so that fuel delivered to the engine by the pump flows through the filter. A pressure regulator has a flow inlet connected to the pump outlet and a pressure reference inlet connected to the outlet side of the fuel filter. The outlet of the pressure regulator is connected to return fuel to the fuel supply bypassing the filter as a function of fuel pressure at the outlet side of the filter, so as to maintain substantially constant fuel pressure delivery to the engine. Preferably, a check valve is positioned between the filter outlet and the fuel line to the engine so as to prevent reverse flow of fuel from the engine to the supply when the pump is shut down. The reference input to the pressure regulator is connected to the engine fuel line on the downstream side of the check valve. In this way, any pressure increase at the engine and in the fuel line due to heat or the like automatically opens the regulator so as to vent the pump outlet to the supply.

The pressure regulator in the preferred embodiment of the invention comprises a valve that includes a valve element and a valve passage that is selectively opened and closed by motion of the valve element within the passage. The valve passage is connected between the pump outlet and the fuel supply. The filter outlet is connected through the check valve to one side of a diaphragm within the regulator, such that fuel pressure at the downstream side of the check valve urges the valve element to open the passage and vent the pump outlet to the supply. A coil spring is coupled to the diaphragm in opposition to the force of such fuel pressure so as to urge the valve element to close the passage. In this way, fuel from the pump outlet bypasses the filter and is returned to the supply only when fuel outlet pressure to the engine exceeds the force of the spring, and only to the extent such pressure exceeds the spring force.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
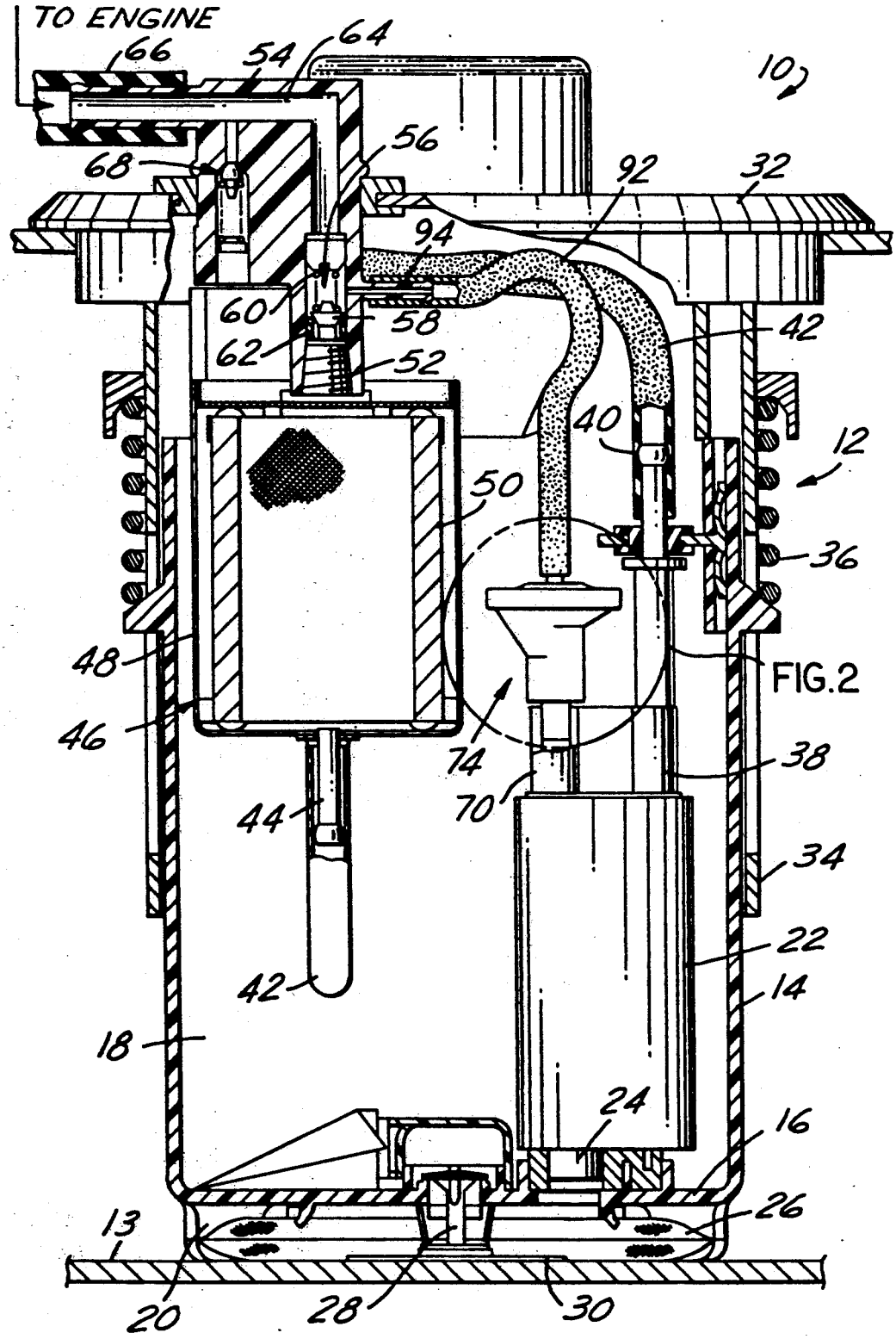
FIG. 1 is a fragmentary sectional view in side elevation of an in-tank fuel delivery module in accordance with a presently preferred embodiment of the invention.

FIG. 1 illustrates a fuel delivery system 10 in accordance with a presently preferred embodiment of the invention as comprising a module assembly 12 adapted for immersion within a vehicle fuel tank 13 for delivering fuel under pressure to a remote engine (not shown). Module 12 includes a substantially cylindrical canister 14 having a septum or wall 16 that divides canister 14 into upper and lower canister sections 18,20 respectively. An electric-motor fuel pump 22 is mounted within upper canister chamber 18, and has an inlet 24 that extends through wall 16 into lower canister chamber 20. A filter 26 surrounds the pump inlet within chamber 20. A valve 28 is mounted on canister wall 16, and is responsive to movement of a diaphragm 30 carried by filter 26 to open communication between upper canister chamber 18 and lower canister chamber 20. To the extent thus far described, module 12 is essentially similar to those disclosed in U.S. Pat. No. 4,747,388, the disclosures of which are incorporated herein by reference for further discussion of structure and operation. A cap 32 has a depending sleeve 34 that surrounds the upper portion of canister 14. A coil spring 36 is captured in compression between sleeve 34 and canister 14 so that, when cap 32 is affixed to and closes the mounting opening in tank 13, spring 36 urges the lower end of canister 14 against the bottom wall of tank 13 as shown in FIG. 1.

The outlet of pump 22 is divided by pump outlet end cap 38 into two flow paths. A first outlet flow path is connected by a fitting 40 and a hose 42 to the inlet 44 of a fuel filter assembly 46. Filter assembly 46 includes a closed canister 48 housing a cylindrical filter element 50. A fitting 52 extends from the upper end of filter canister 48, and receives an outlet manifold 54. Manifold 54 includes a check valve 56 in which a valve element 58 is urged by a spring 60 against a seat 62 adjacent to filter outlet fitting 52. A passage 64 extends from check valve 56 within manifold 54 to form a pump module outlet that is connected by a hose 66 to the fuel rail of the engine (not shown). A pressure relief valve 68 is coupled to fuel passage 64 on the downstream side of check valve 56 within manifold 54 for dumping fuel from passage 64 to upper canister chamber 18 in the event of over-pressure of fuel in passage 64, fuel line 66 and at the engine fuel rail. To the extent thus far described, manifold 54, including check valves 56,68, is generally similar to that disclosed in U.S. Pat. No. 5,044,344, the disclosure of which is incorporated herein by reference.

Figure 2:
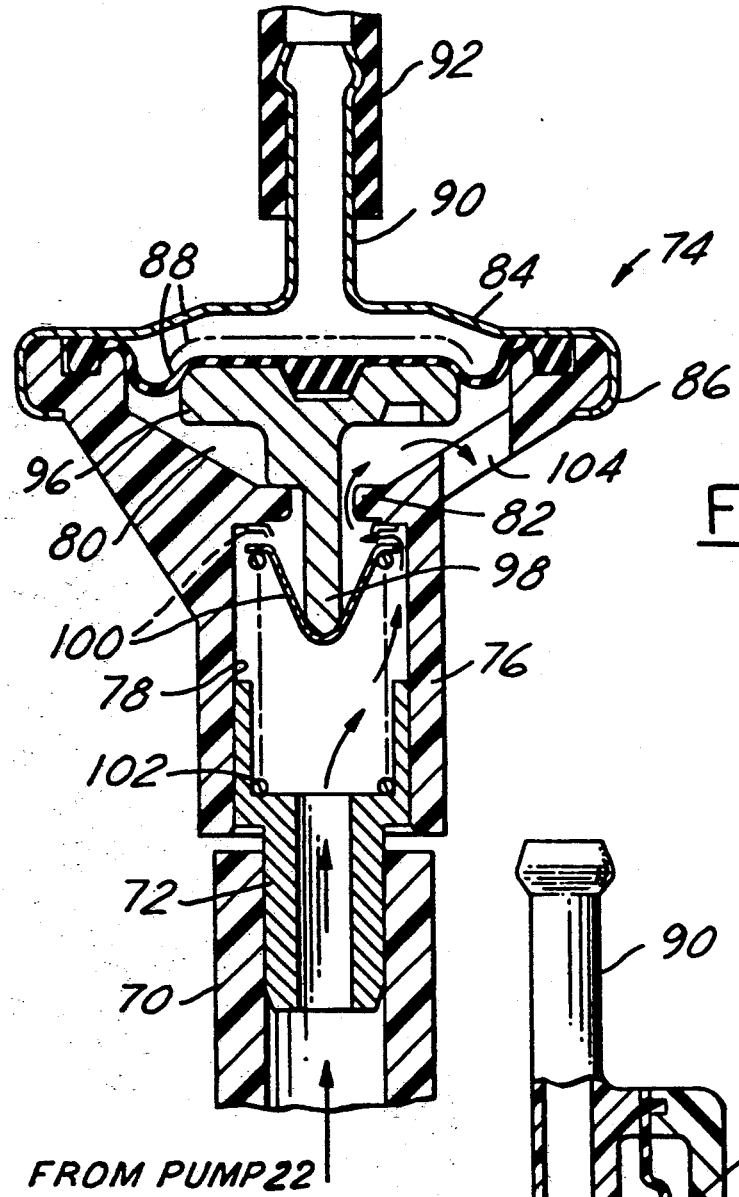
FIG. 2 is a fragmentary sectional view on an enlarged scale of a portion of the module illustrated in FIG. 1; modified pressure regulators in accordance with the invention.
Figure 6:
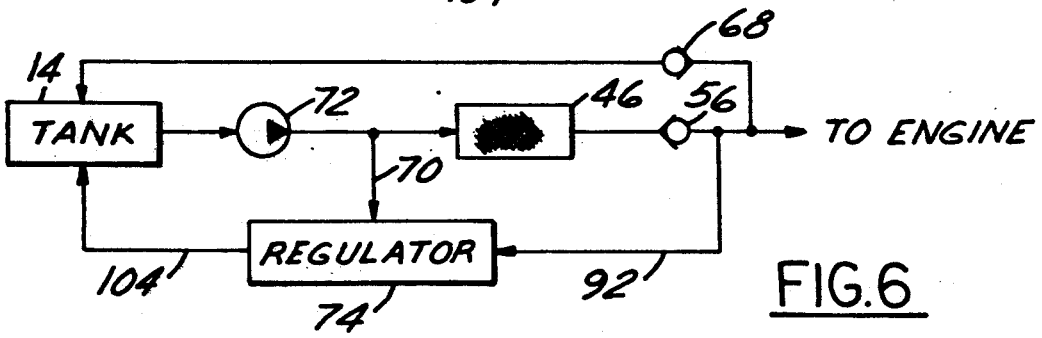
FIG. 6 is a schematic diagram of the fuel delivery system module illustrated in FIGS. 1–2.

In accordance with the present invention, the second outlet path from pump outlet end cap 38 is connected by a hose 70 (FIGS. 1, 2 and 6) to the flow inlet 72 of a pressure regulator 74 (FIGS. 1 and 2). Inlet fitting 72 is mounted within a shell 76 that flares outwardly remotely of fitting 72 to form an internal passage 78 and an upper volume 80 separated from each other by a valve seat ledge 82. An end cap or ring 84 is crimped at 86 over the open end of shell 76 so as to capture a diaphragm 88 within volume 80. Diaphragm 88 is of any suitable flexible construction. An open neck 90 extends from cap 84 coaxially with shell passage 78. A hose 92 connects neck 90 to a port 94 (FIG. 1) on manifold 54, which opens into fuel passage 64 immediately downstream of check valve 56.

Within pressure regulator 74, diaphragm 88 effectively divides volume 80 into upper and lower chambers in the orientation of FIG. 1, the upper chamber communicating through neck 90 and hose 92 with port 94 on manifold 54, and the lower chamber communicating through seat 82 and passage 78 with the pump outlet. An actuator 96 is mounted on diaphragm 88, and has a finger 98 that projects into passage 78 through the opening defined by valve seat 82. A valve element 100 is carried within passage 78. A coil spring 102 is captured in compression within passage 78 between valve element 100 and inlet fitting 72, and thus urges valve element 100 against seat 82. An open port 104 extends through the sidewall of shell 76 from volume 80 downstream of seat 82.

In operation, the force of coil spring 102 against valve element 100 normally urges valve element 100 and diaphragm 88 upwardly in the orientation of FIG. 2 to the positions shown fragmentarily in phantom, so as to close valve element 100 against seat 82 and prevent flow of fuel through passage 78 to port 104. On the other hand, when the pressure of fuel on the downstream side of check valve 56 is sufficient to overcome the force of spring 102, the force of the fuel pressure on diaphragm 88 moves actuator 96 and element 100 downwardly toward the position shown in solid lines in FIG. 2, permitting flow of fuel through passage 78, past seat 82 into volume 80 and thence through port 104, as shown by the directional arrows in FIG. 2. Thus, when fuel outlet pressure at the filter exceeds the force exerted by spring 102, a portion of the output of pump 22 is automatically bypassed and returned to the interior volume of the fuel canister, thereby tending to reduce the pressure of fuel flowing through the filter to the engine.

Preferably, spring 102 is chosen so that regulator 74 is partially opened during normal operation. That is, spring 102 is selected at the time of regulator manufacture in coordination with desired nominal fuel pressure to be provided by the module assembly so that regulator 74 is normally partially open, and a portion of the fuel supplied by the pump bypasses filter 46 and is returned to the supply, while the remainder flows through the filter to the engine. In the event that fuel outlet pressure at check valve 56 decreases due to clogging of the fuel filter or due to increased fuel demand at the engine, regulator 74 will tend to close under force of spring 102, so that a greater amount of the pump outlet is fed through the filter to the engine. On the other hand, in event that fuel pressure at check valve 56 increases due to reduced fuel demand at the engine, for example, such increased fuel pressure tends further to open regulator 74, so that a greater portion of the output of fuel pump 22 bypasses filter 46 and is returned to the fuel supply. Thus, fuel pump 22 may be connected directly to the vehicle electrical power system so as to deliver constant output flow, and regulator 74 will function automatically to apportion such flow between the output line through the filter and the return path to the supply so as to maintain desired constant outlet pressure at check valve 56.

It will also be noted, in accordance with an important feature of the present invention, that connection of the reference input to regulator 74 on the downstream side of check valve 56 will function automatically to vent the pump outlet in the event of excess temperature at the fuel supply and engine. That is, in the event that pressure within fuel line 66 and manifold passage 64 increases due to high temperature at the engine, such pressure will operate on regulator 74 so as to open passage 78 as shown in solid lines in FIG. 2, and thereby vent the outlet of pump 22 to the open volume of canister 14. Any fuel vapors that form in the pump housing are thereby automatically vented to the surrounding canister.

Figure 3:
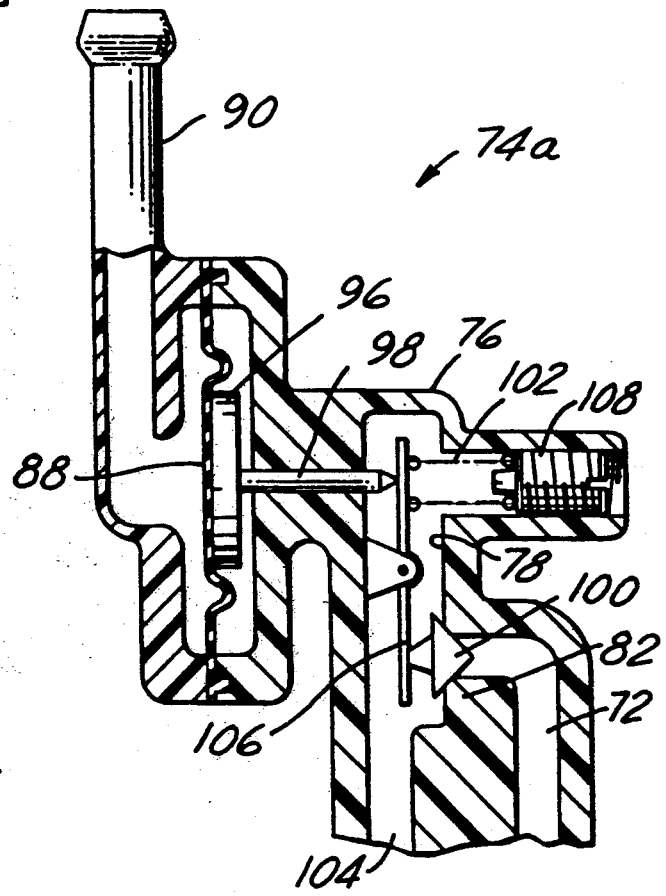
FIGS. 3–5 are fragmentary sectional views of respective modified pressure regulators in accordance with the invention.
Figure 4:
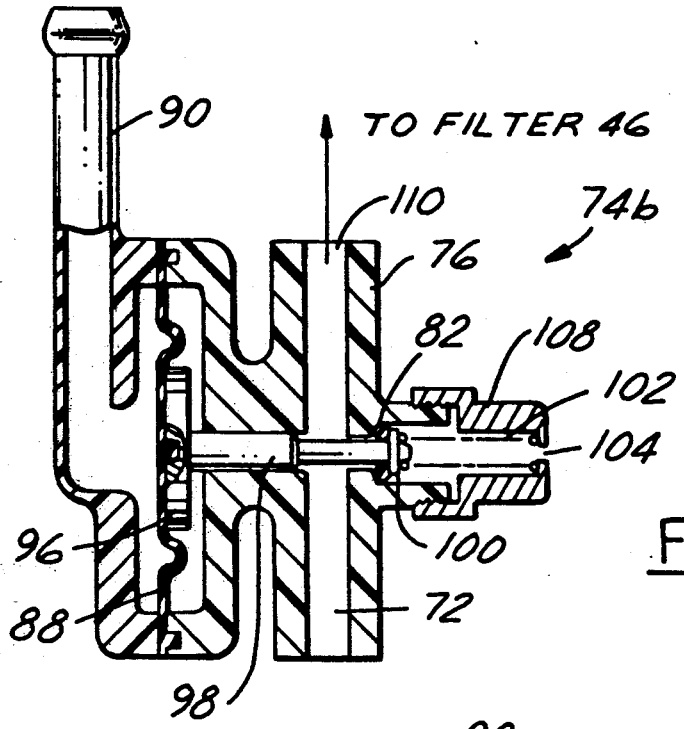
Figure 5:
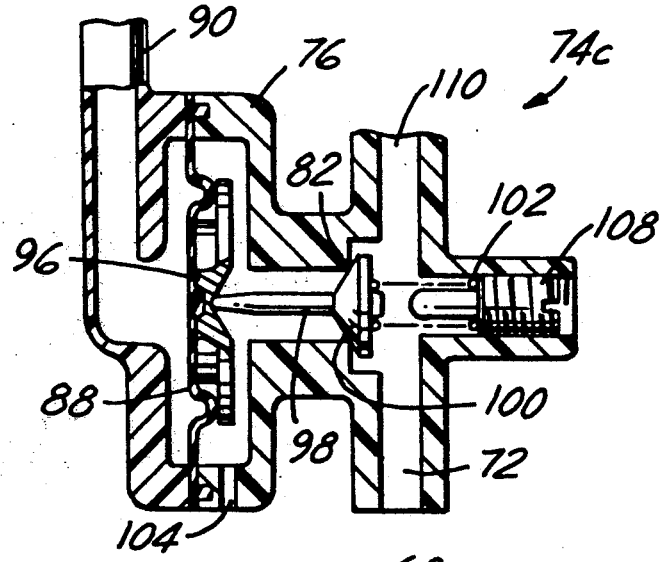

FIGS. 3-5 illustrate modified pressure regulators 74a,74b and 74c respectively. In each of the FIGS. 3-5, elements structural or functionally equivalent to corresponding elements in regulator 74, hereinabove described in detail in connection with FIG. 2, are indicated by correspondingly identical reference numerals. In regulator 74a of FIG. 3, valve element 100 is mounted on one end of a lever 106 that is pivotally mounted within passage 78 of shell 76. Finger 98 of actuator 96 engages the opposing end of lever 106 against the force of coil spring 102. The opposing seat for spring 102 is formed by a nut 108 that is threadably received within shell 76 so as to provide for selective adjustment of the force applied by spring 102 on lever 106. Thus, as in the embodiment of FIG. 2, when the fuel pressure against diaphragm 88 is sufficient to overcome the force applied by spring 102, valve element 100 is moved away from valve seat 82 so as to open communication between inlet 72 and bypass port 104.

Pressure regulators 74b and 74c have the advantage over regulators 74,74a hereinabove discussed in that they can be employed in connection with a fuel pump 22 (FIG. 1) having only a single or undivided outlet passage. Thus, in FIG. 4, the shell 76 of regulator 74b includes a primary fuel flow path that extends from inlet 72 to an outlet 110 for connection to filter 46, and a bypass path past valve seat 82 and valve element 100 through port 104 (in nut 108) to the interior of canister 14 (FIG. 1). As in the embodiment of FIG. 3, compressive force of spring 102 is adjustable by means of nut 108, which thus serves both to provide such adjustment and to provide the bypass port 104. In the regulator 74c illustrated in FIG. 5, bypass port 104 is provided in regulator shell 76, as in the embodiments of FIGS. 2 and 3.

I claim:

1. A fuel delivery system for an internal combustion engine that includes:

a fuel supply, and a fuel pump having an inlet for drawing fuel from said supply and an outlet, a fuel filter connected to said pump outlet and means for connecting said filter to the engine such that fuel delivered to the engine by said pump flows through said filter, and pressure regulating means having a first input connected to said pump outlet and a second input connected to said filter, and having an outlet for returning fuel to said supply bypassing said filter as a function of fuel pressure at said filter so as to maintain substantially constant fuel pressure delivery to the engine.

said pressure regulating means comprising a valve including a movable valve element and passage means selectively opened by movement of said valve element, means operatively coupling said valve element to said filter outlet such that fuel pressure at said filter outlet urges said valve element to open said passage means and bypass said pump outlet to said supply, and spring means operatively coupled to said valve element in opposition to said fuel pressure at said filter outlet to urge said valve element to close said passage means.

2. The system set forth in claim 8 wherein said pressure regulating means comprises a valve including a movable valve element and passage means selectively opened by movement of said valve element, means operatively coupling said valve element to said filter outlet such that fuel pressure at said filter outlet urges said valve element to open said passage means and bypass said pump outlet to said supply, and spring means operatively coupled to said valve element in opposition to said fuel pressure at said filter outlet to urge said valve element to close said passage means.

3. The system set forth in claim 1 further comprising means for selectively adjusting force of said spring means applied to said valve element.

4. The system set forth in claim 1 further comprising a check valve positioned between said filter means and the engine for preventing reverse flow of fuel from the engine to said supply when said pump is turned off, said second input of said regulating means being connected to said filter downstream of said check valve.

5. A fuel module assembly for immersion in a fuel tank to deliver fuel under pressure from the talk to an engine comprising:

a fuel pump having an inlet and an outlet, means operatively connecting said pump inlet to receive fuel from a surrounding tank, fuel filter means having an inlet and an outlet, means for connecting said inlet of said filter means to said pump outlet and a check valve for connecting said outlet of said filter means to the engine, fuel pressure regulating means having a flow inlet connected to said pump outlet, a reference inlet connected to said outlet of said filter means downstream of said check valve, and a flow outlet for returning fuel to the tank, and means for interconnecting said flow inlet and said flow outlet when pressure at said reference inlet . exceeds a preselected threshold, and frame means mounting said pump, filter means, pressure regulating means and said connecting means as a integral assembly adapted for immersion in the fuel tank.

6. The assembly set forth in claim 5 further comprising means for selectively adjusting said threshold.

7. The system set forth in claim 5 wherein said regulating means comprises a valve including a valve element and a valve passage connected at one end to said pump outlet, a diaphragm coupled to said valve element, means for connecting said filter outlet to one side of said diaphragm such that fuel pressure at said filter outlet urges said valve element to open said passage, and spring means coupled to said diaphragm in opposition to such fuel pressure so as to urge said valve element to close said passage.

8. A fuel delivery system for an internal combustion engine that includes:

a fuel supply, and a fuel pump having an inlet for drawing fuel from said supply and an outlet, a fuel filter connected to said pump outlet and means for connecting said filter to the engine such that fuel delivered to the engine by said pump flows through said filter, pressure regulating means having a first input connected to said pump outlet and a second input connected to said filter, and having an outlet for returning fuel to said supply bypassing said filter as a function of fuel pressure at said filter so as to maintain substantially constant fuel pressure delivery to the engine, and a check valve positioned between said filter means and the engine for preventing reverse flow of fuel from the engine to said supply when said pump is turned off, said second input of said regulating means being connected to said filter downstream of said check valve.

* * * * *

UNITED STATES PATENT OFFICE

CERTIFICATE OF CORRECTION

PATENT NO. : 5,195,494

DATED : March 23, 1993

INVENTOR(S) : Charles H. Tuckey

It is certified that error appears in the above-identified patent and that said Letters Patent are hereby corrected as shown below:

Col. 6, Line 26, change "talk" to — tank —.

Signed and Sealed this

Twenty-fifth Day of January, 1994

Bruce Lehman

*Attest:*

BRUCE LEHMAN

*Attesting Officer*

*Commissioner of Patents and Trademarks*